US011077437B2

(12) United States Patent
Medoro et al.

(10) Patent No.: US 11,077,437 B2
(45) Date of Patent: Aug. 3, 2021

(54) MICROFLUIDIC SYSTEM

(71) Applicant: Menarini Silicon Biosystems S.p.A., Castel Maggiore (IT)

(72) Inventors: Gianni Medoro, Casalecchio di Reno (IT); Alex Calanca, Mirandola (IT)

(73) Assignee: Menarini Silicon Biosystems S.p.A., Castel Maggiore (IT)

( * ) Notice: Subject to any disclaimer, the term of this patent is extended or adjusted under 35 U.S.C. 154(b) by 241 days.

(21) Appl. No.: 16/342,940

(22) PCT Filed: Oct. 18, 2017

(86) PCT No.: PCT/IB2017/056473
§ 371 (c)(1),
(2) Date: Apr. 17, 2019

(87) PCT Pub. No.: WO2018/073760
PCT Pub. Date: Apr. 26, 2018

(65) Prior Publication Data

US 2020/0055043 A1 Feb. 20, 2020

(30) Foreign Application Priority Data

Oct. 18, 2016 (IT) ..... 102016000104601

(51) Int. Cl.
*B01L 3/00* (2006.01)
*B01L 7/00* (2006.01)

(52) U.S. Cl.
CPC ..... *B01L 3/502707* (2013.01); *B01L 3/50273* (2013.01); *B01L 7/00* (2013.01);
(Continued)

(58) Field of Classification Search
CPC ..... B01L 2200/0652; B01L 2300/047; B01L 2300/0627; B01L 2300/0645;
(Continued)

(56) References Cited

U.S. PATENT DOCUMENTS 7,485,454 B1 2/2009 Jury et al.
8,852,644 B2 10/2014 Baumstuemmler et al.
(Continued)

FOREIGN PATENT DOCUMENTS

CN 1502130 A 6/2004
CN 2767978 Y 3/2006
(Continued)

OTHER PUBLICATIONS

International Search Report and Written Opinion, corresponding International application No. PCT/IB2017/056473, dated Dec. 14, 2017.
(Continued)

*Primary Examiner* — Jennifer Wecker
*Assistant Examiner* — Jonathan Bortoli
(74) *Attorney, Agent, or Firm* — Marshall, Gerstein & Borun LLP

(57) ABSTRACT

A microfluidic system for the isolation of particles of at least one given type belonging to a sample and comprising a separation unit, which is designed to transfer the particles of given type from a main chamber to a recovery chamber in a substantially selective manner with respect to further particles of the sample; at least one first reservoir, which is designed to contain a liquid and is fluidically connected to the separation unit; and a regulating assembly, which comprises at least a first regulating device having a first heat transfer element arranged at the first reservoir to adjust the temperature of the first reservoir, in particular to absorb heat from the reservoir.

22 Claims, 5 Drawing Sheets

(52) U.S. Cl.
CPC . *B01L 2300/047* (2013.01); *B01L 2300/0627* (2013.01); *B01L 2300/0645* (2013.01); *B01L 2300/0809* (2013.01); *B01L 2300/0883* (2013.01); *B01L 2300/1822* (2013.01); *B01L 2400/0415* (2013.01)

(58) Field of Classification Search
CPC ..... B01L 2300/0663; B01L 2300/0809; B01L 2300/0816; B01L 2300/0883; B01L 2300/1822; B01L 2300/185; B01L 2300/1894; B01L 2400/0415; B01L 3/502707; B01L 3/50273; B01L 3/502761; B01L 7/00
See application file for complete search history.

(56) References Cited

U.S. PATENT DOCUMENTS

| | | | | |
|---|---|---|---|---|
| 2002/0075651 | A1 | 6/2002 | Newton et al. | |
| 2004/0121454 | A1 | 6/2004 | Jury et al. | |
| 2009/0269767 | A1 | 10/2009 | Soderlund et al. | |
| 2009/0294271 | A1 | 12/2009 | Holmberg et al. | |
| 2010/0165784 | A1 | 7/2010 | Jovanovich et al. | |
| 2010/0255473 | A1 | 10/2010 | Ermantraut et al. | |
| 2012/0184010 | A1* | 7/2012 | Medoro ..... | B03C 5/026 435/173.9 |
| 2013/0343966 | A1 | 12/2013 | Medoro et al. | |
| 2014/0045704 | A1 | 2/2014 | Jovanovich et al. | |

FOREIGN PATENT DOCUMENTS

| | | | |
|---|---|---|---|
| CN | 1847802 | A | 10/2006 |
| CN | 101095384 | A | 12/2007 |
| CN | 101495933 | A | 7/2009 |
| CN | 101715483 | A | 5/2010 |
| CN | 201600153 | U | 10/2010 |
| CN | 102341691 | A | 2/2012 |
| CN | 102427883 | A | 4/2012 |
| CN | 103282127 | A | 9/2013 |
| CN | 103667054 | A | 3/2014 |
| CN | 205120530 | U | 3/2016 |
| CN | 105543084 | A | 5/2016 |
| JP | 2007-038058 | A | 2/2007 |
| JP | 2012-530246 | A | 11/2012 |
| JP | 2013-522028 | A | 6/2013 |
| WO | WO-00/69565 | A1 | 11/2000 |
| WO | WO-2007/010367 | A3 | 4/2007 |
| WO | WO-2007049120 | A2 | 5/2007 |
| WO | WO-2009/125067 | A1 | 10/2009 |
| WO | WO-2010/106426 | A1 | 9/2010 |
| WO | WO-2010/106428 | A2 | 9/2010 |
| WO | WO-2010/106434 | A1 | 9/2010 |
| WO | WO-2010/144745 | A2 | 12/2010 |
| WO | WO-2012/085884 | A1 | 6/2012 |

OTHER PUBLICATIONS

International Preliminary Report on Patentability, corresponding International Application No. PCT/IB2017/056473, dated Sep. 18, 2018.
PCT Direct/Informal Comments filed in International Application No. PCT/IB2017/056473 dated Oct. 18, 2017.
Article 34 Amendments and Response to the International Search Report and Written Opinion dated Aug. 20, 2019.
The Notification of the First Office Action in Chinese Counterpart Application No. 201780064746.0 dated Feb. 3, 2021.
First search report in Chinese Counterpart Application No. 201780064746.0 dated Jan. 26, 2021.
Japanese Patent Application No. 2019-541902, Notice of Reasons for Refusal, dated Jun. 9, 2021.

* cited by examiner

MICROFLUIDIC SYSTEM

CROSS-REFERENCE TO RELATED APPLICATION

This application is a U.S. National Stage of International Patent Application No. PCT/IB2017/056473 filed Oct. 18, 2017, which claims the benefit of priority of Italian Application No. 102016000104601 filed Oct. 18, 2016, the respective disclosures of which are each incorporated herein by reference in their entireties.

TECHNICAL FIELD

The present invention relates to a microfluidic system for the isolation of particles and an apparatus for the manipulation of particles.

BACKGROUND OF THE INVENTION

In the field of the isolation of small particles belonging to a sample, systems are known comprising a first inlet through which, in use, the sample is introduced into the system; a separation unit, which comprises a main chamber and a recovery chamber and is designed to transfer at least part of the particles of given type from the main chamber to the recovery chamber in a selective manner with respect to further particles of the sample; one or more reservoirs, designed to contain liquid and fluidically connected to the separation unit; one or more actuators to move the liquid from the reservoirs to the separation unit.

In these types of systems, part of the particle conveying is performed by moving the liquid (typically a buffer solution) in which the particles are contained. However, it has been experimentally observed that this type of movement is not always reliable and accurate (it does not give repeatable results).

Also, the selective movement of the particles inside the separation unit, said movement typically being performed by exploiting other systems (e.g. dielectrophoresis or magnetophoresis), is in some cases not fully reliable and accurate.

The object of the present invention is to provide a microfluidic system for the isolation of particles and an apparatus for the manipulation of particles which overcome, at least partially, the drawbacks of the known art and are, at the same time, easy and inexpensive to produce.

SUMMARY

According to the present invention, a microfluidic system for the isolation of particles and an apparatus for the manipulation of particles are provided as defined in the following independent claims and, preferably, in any one of the claims depending directly or indirectly on the independent claims.

Unless explicitly specified otherwise, in the present text the following terms have the meaning indicated below.

By equivalent diameter of a section it is meant the diameter of a circle having the same area as the section.

By microfluidic system it is meant a system comprising at least one microfluidic channel and/or at least one microfluidic chamber. In particular, the microfluidic system comprises at least one pump (more specifically, a plurality of pumps), at least one valve (more specifically, a plurality of valves) and if necessary at least one gasket (more specifically, a plurality of gaskets).

In particular, by microfluidic channel it is meant a channel having a section with equivalent diameter smaller than 0.5 mm.

In particular, the microfluidic chamber has a height of less than 0.5 mm. More specifically, the microfluidic chamber has a width and a length greater than the height (more precisely at least five times the height).

In the present text, by particle it is meant a corpuscle having largest dimension smaller than 500 μm (advantageously smaller than 150 μm). Non-limiting examples of particles are: cells, cell debris (in particular, cell fragments), cell aggregates (e.g. small clusters of cells deriving from stem cells such as neurospheres or mammospheres), bacteria, lipospheres, microspheres (in polystyrene and/or magnetic), complex nanospheres (e.g. nanospheres up to 100 nm) formed of microspheres bound to cells. Advantageously, the particles are cells.

According to some embodiments, the particles (advantageously cells and/or cell debris) have their largest dimension less than 60 μm.

The dimensions of the particles can be measured in a standard manner using microscopes with graduated scale or ordinary microscopes used with slides (on which the particles are deposited) having a graduated scale.

In the present text, by dimensions of a particle it is meant the length, width and thickness of the particle.

The term "selective" is used to identify a movement (or other analogous terms indicating a movement and/or a separation) of particles, in which the particles that are moved and/or separated are particles mostly of one or more given types. Advantageously, a selective movement (or other analogous terms indicating a movement and/or a separation) entails moving particles with at least 90% (advantageously 95%) of particles of the given type/s (percentage given by the number of particles of the given type/s with respect to the number of overall particles).

BRIEF DESCRIPTION OF THE FIGURES

The invention is described below with reference to the accompanying drawings, which illustrate some non-limiting embodiments thereof, in which.

DETAILED DISCLOSURE

Figure 1:
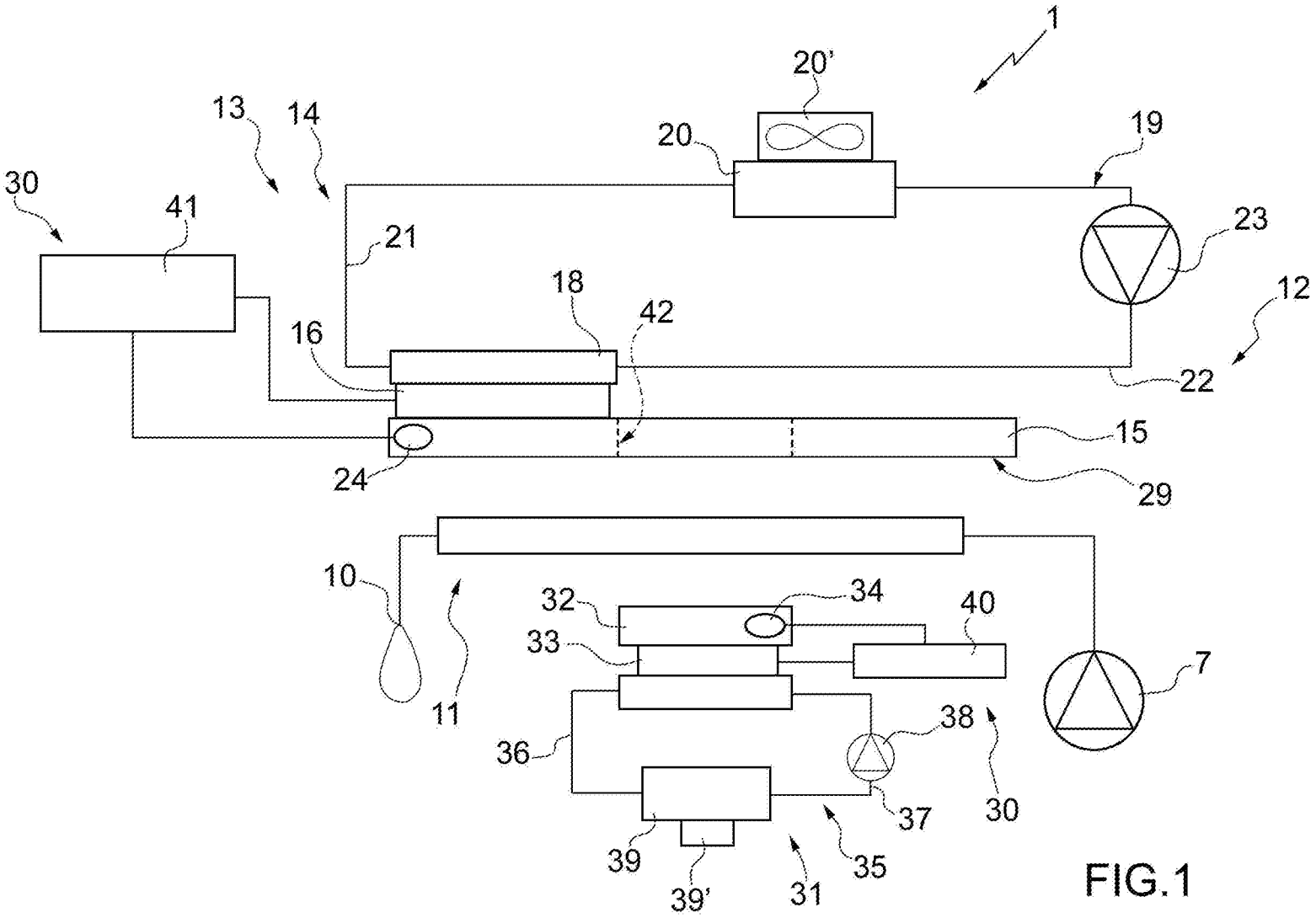
FIG. 1 is a schematic lateral view of a system according to the present invention.

In FIG. 1, the number 1 indicates overall a microfluidic system for the isolation of particles of at least one given type belonging to a sample. The system 1 comprises an inlet 2 (FIG. 6), through which, in use, the sample is introduced into the system 1; a separation unit 3, which comprises a main chamber 4 and a recovery chamber 5 and is designed to transfer at least part of the particles of given type from the main chamber 4 to the recovery chamber 5 in a substantially selective manner with respect to further particles of the sample. The system 1 also comprises at least one reservoir 6, which is designed to contain a liquid and is fluidically (and directly) connected to the separation unit 3; and at least one actuator 7 (in particular, a pump or a reservoir under pressure—FIG. 1) to move the liquid into the (along the) reservoir 6 and at least part of the separation unit 3. In particular, the actuator 7 is designed to move the liquid from the reservoir 6 to the separation unit 3.

In particular, the reservoir 6 has a (internal) volume of at least 1 μL. More specifically, the reservoir 6 has a (internal) volume of up to 10 mL.

According to some non-limiting embodiments, the structure and operation of the system 1 correspond to those described in the patent applications with publication number WO2010/106428 and WO2010/106426.

It should be noted that according to embodiments that are alternative to each other, the reservoir 6 is designed to contain the sample (if necessary diluted in a buffer solution) or is designed to contain a transport liquid (more precisely, a buffer solution), which, in particular, is used in use to convey the particles by entrainment.

In particular, in the first case, the reservoir 6 is fluidically (directly) connected to the main chamber 4 and the actuator 7 is designed to move the liquid (containing the sample) from the reservoir 6 to the main chamber 4. In particular, in the second case, the reservoir 6 is fluidically (directly) connected to the recovery chamber 5 and the actuator 7 is designed to move the transport liquid from the reservoir 6 to the recovery chamber 5 (and if necessary, subsequently, to the main chamber 4 and/or to an outlet 10).

According to some variations, the reservoir 6 is connected fluidically (directly) to the main chamber 4 and is designed to contain a transport liquid (more precisely, a buffer solution) which, in particular, is used, in use, to convey the particles by entrainment. In these cases, the actuator 7 is designed to move the transport liquid from the reservoir 6 (directly) to the main chamber 4.

Figure 6:
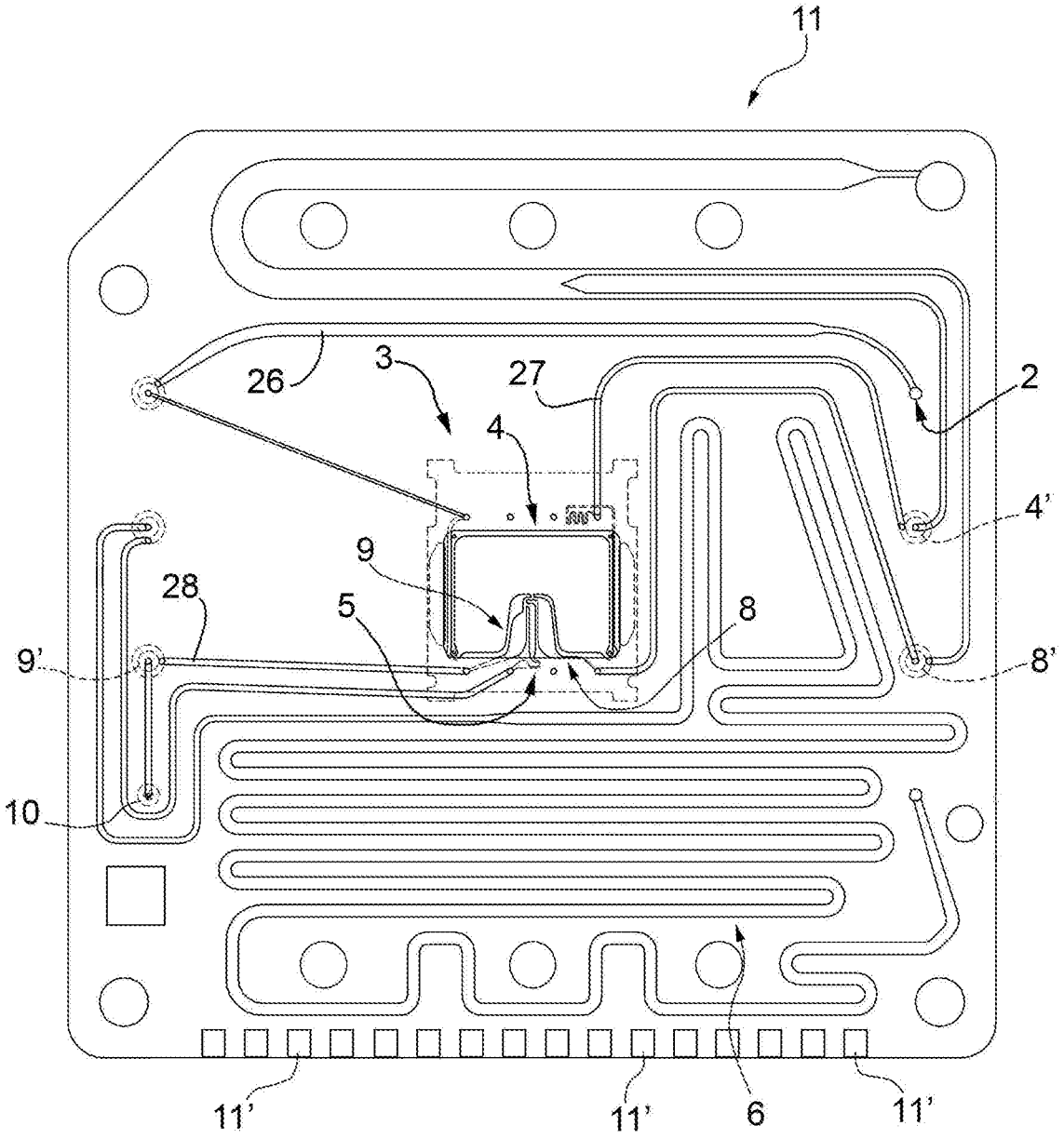
FIG. 6 is a plan view of an element of the exploded view of FIG. 2.

In practice, according to some non-limiting embodiments and when the reservoir 6 is connected to the recovery chamber 5 and contains the transport liquid, in use, the sample (or a portion thereof) is conveyed into the main chamber 4 (FIG. 6). The particles of given type are selectively moved (for example by means of dielectrophoresis) from the main chamber 4 to a waiting area 8 of the recovery chamber 5. At this point, due to the actuator 7 (FIG. 1) a flow of a saline solution is made to flow (by appropriately operating the various valves provided; in particular, by keeping open a valve 4' arranged at the outlet of the main chamber 4 and keeping closed the valves 8' and 9' arranged at the outlet of the recovery chamber 5) from the reservoir 6 (FIG. 6) through the main chamber 4. The particles are therefore moved from the waiting area 8 to a recovery area 9 of the recovery chamber 5. At this point, due to the actuator 7 a flow of a saline solution is made to flow (by appropriately operating the various valves provided; in particular, by keeping closed the valves 8' and 9' arranged at the outlet of the main chamber 4 and of the waiting area 8 and by keeping open the valve 9' arranged at the outlet of the recovery area 9) from the reservoir 6 through the recovery area 9 so that the particles are sent to the outlet 10, from which they can then be recovered.

Note that when it is indicated that two elements are "directly" connected and/or in contact, we mean that no further element is interposed.

Figure 2:
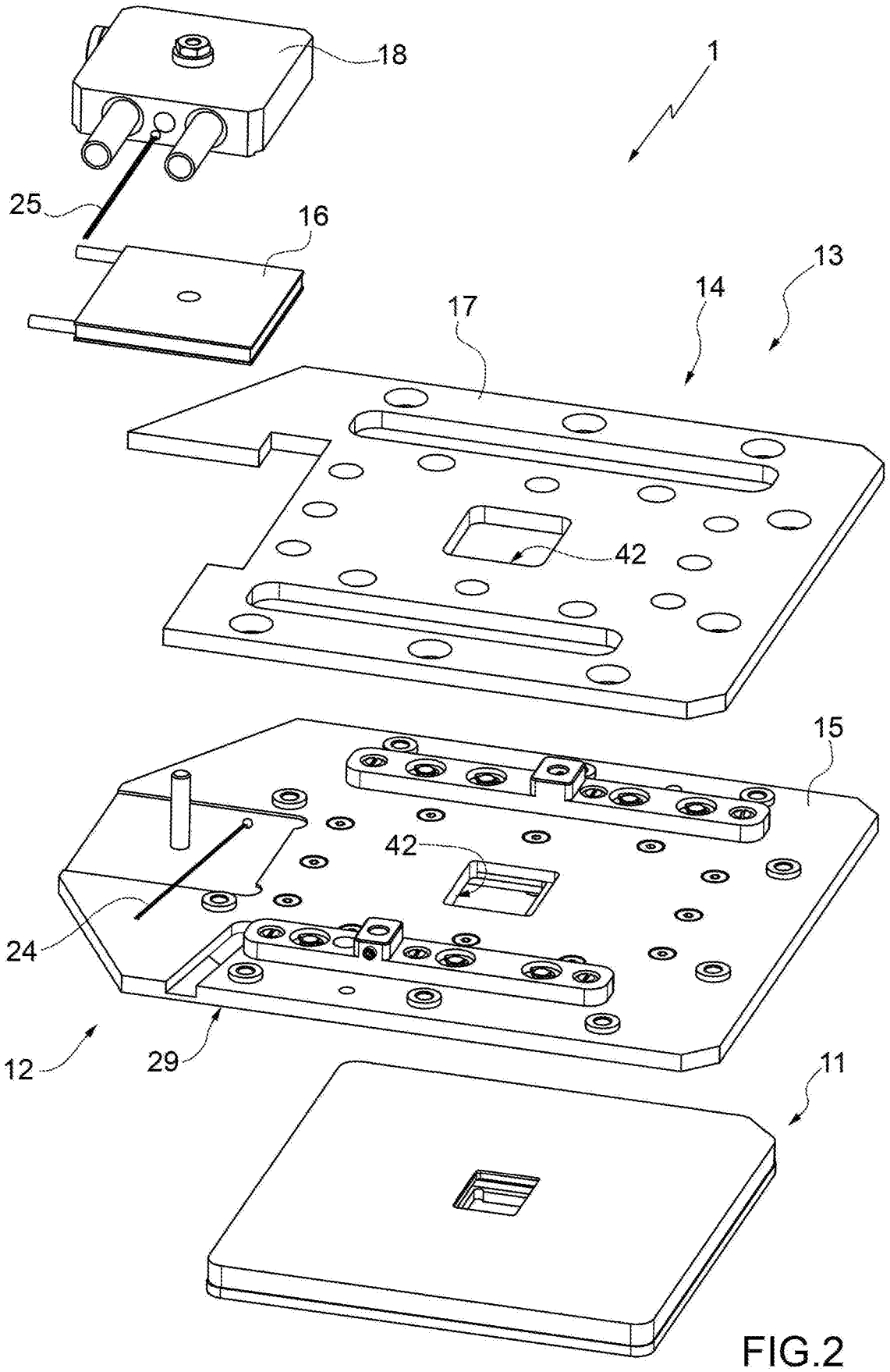
FIG. 2 is a perspective exploded view of a part of the system of FIG. 1.

According to some non-limiting embodiments, the system 1 comprises a microfluidic device 11 and an apparatus 12 (FIGS. 1 and 2) for the manipulation (isolation) of particles. In particular, the microfluidic device 11 and an apparatus 12 are as described in the patent applications with publication number WO2010/106434 and WO2012/085884.

The system 1 further comprises a regulating assembly 13, which comprises at least one regulating device 14 having at least one heat transfer element 15 arranged at (in particular, in contact with) the reservoir 6 to adjust the temperature of the reservoir 6, in particular to absorb heat from the reservoir 6. More precisely, the element 15 comprises (is made of) a material designed to conduct heat (in particular, metal; more specifically, copper). In particular, the element 15 is not present at (in contact with) the separation unit 3 (more precisely, at the main chamber 4 and the separation chamber 3). According to some embodiments, the distance between the element 15 and the reservoir 6 is shorter than the distance from the element 15 to the separation unit 3 (more precisely, to the main chamber 4 and to the separation chamber 3).

Figure 4:
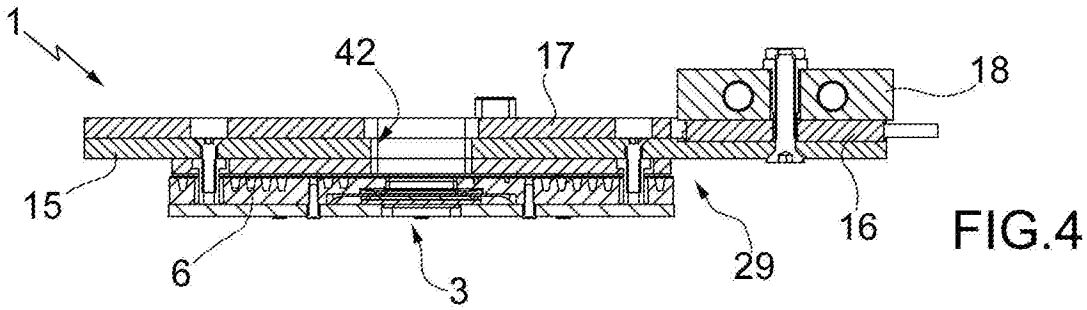
FIG. 4 illustrates a section along the line IV-IV of the part of FIG. 3.
Figure 3:
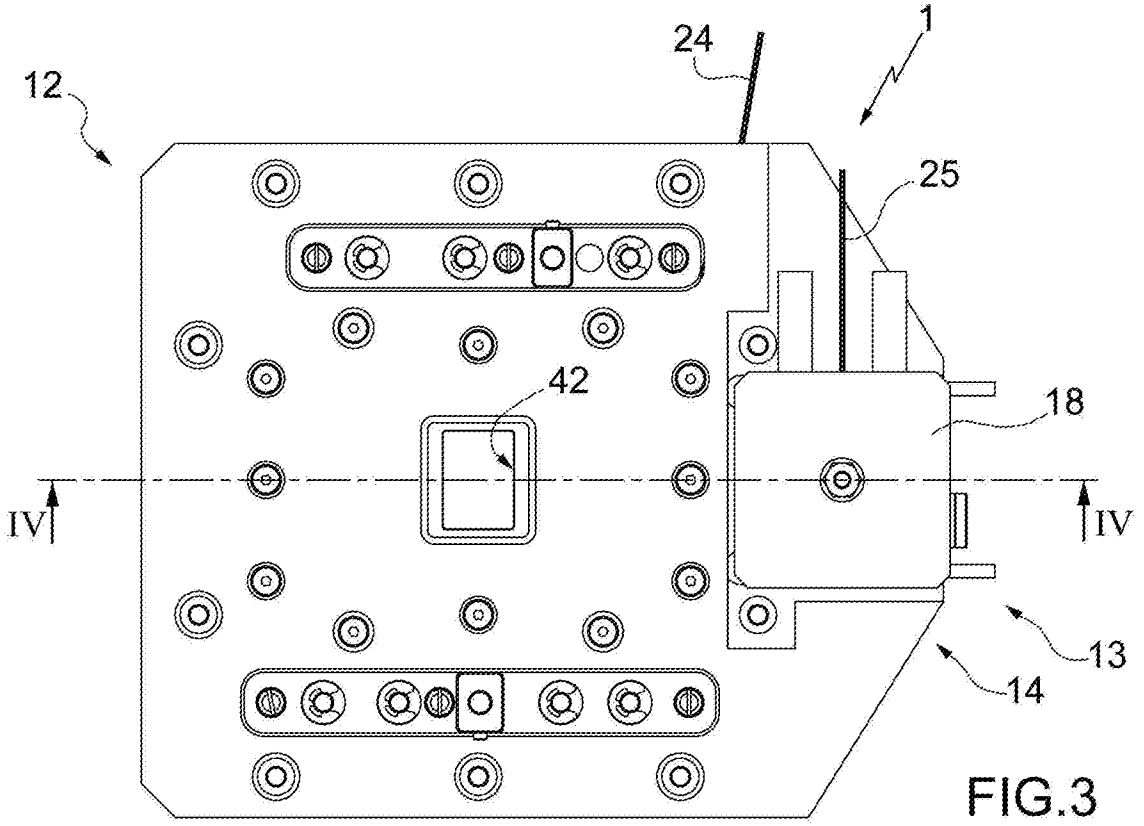
FIG. 3 is a plan view of the part of FIG. 2.

In some cases, the element 15 comprises (is) a plate. According to specific embodiments (like the one illustrated—see in particular FIG. 4), the element 15 comprises (is) two overlapping plates.

In particular, the regulating assembly 13, by means of the regulating device 14, which acts, in use, via the element 15, is designed to adjust the temperature of the reservoir 6 (more specifically, so as to maintain the temperature of the reservoir 6 within a given range). Advantageously but not necessarily, the regulating device 14 is designed to remove heat from the element 15 (and, therefore, from the reservoir 6).

More precisely, the element 15 (in particular, the regulating device 14) is designed to transfer heat from and/or to (in particular, remove heat from) a wall of the reservoir 6.

It has been experimentally and surprisingly observed that by controlling the temperature of the liquid in the reservoir 6 it is possible to obtain a more reliable, accurate and reproducible movement of the particles.

This is probably due mainly to two factors. Firstly, control of the temperature allows the viscosity of the liquid to be controlled and maintained within a narrow range. Secondly, maintaining the temperature controlled (in particular, preventing it from increasing) reduces the risk of air bubbles developing.

In relation to the first issue, it should be noted that by reducing the viscosity of the liquid, the quantity of liquid necessary to move particles by entrainment decreases due to a variation in the Reynolds number.

As regards the second issue, it should be noted that air bubbles create obstructions that block the movement of the particles (also in the separation unit 3).

According to some non-limiting embodiments, the regulating assembly 13 (more precisely, the regulating device 14) comprises a heat pump 16 to draw heat from the element 15. Advantageously but not necessarily, the heat pump 16 is directly in contact (i.e. without the interposition of further elements) with the element 15. In particular, the heat pump 16 comprises (is) a Peltier cooler.

According to some non-limiting embodiments, the heat pump 16 (Peltier cooler) is designed to operate with a power of 5-8 Watt (in particular, 6-7 Watt).

Advantageously but not necessarily, the regulating assembly 13 (more precisely, the regulating device 14) comprises a thermal insulator 17 (illustrated in FIG. 2) arranged on the opposite side of the element 15 with respect to the reservoir 6. In particular, the thermal insulator 17 is directly in contact with a surface of the element 15 facing the opposite side with respect to the reservoir 6. More precisely but not necessarily, the thermal insulator 17 covers said surface (with the exception of an area in which the heat pump 16 is arranged in contact with the element 15).

According to some non-limiting embodiments, the regulating assembly 13 (more precisely, the regulating device 14) comprises a liquid heat exchanger 18. In particular, the heat exchanger 18 is connected to a cooling circuit 19 (FIG. 1) provided with a radiator 20, two ducts 21 and 22, which fluidically connect the heat exchanger 18 and the radiator 20, a fan 20' for cooling the liquid present in the radiator 20 and a pump 23 for conveying the cooling liquid along the ducts 21 and 22 and through the heat exchanger 18 and the radiator 20.

Advantageously but not necessarily, the regulating assembly 13 (more precisely, the regulating device 14) comprises a temperature sensor 24 to detect the temperature of the element 15. In particular, the sensor 24 is arranged in direct contact with the element 15.

According to some non-limiting embodiments, the regulating assembly 13 (more precisely, the regulating device 14) comprises a temperature sensor 25 to detect the temperature of the heat exchanger 18. In particular, the sensor 25 is arranged in direct contact with the heat exchanger 18.

According to some non-limiting embodiments (and if the reservoir 6 contains the transport liquid and, therefore, is fluidically connected to the recovery chamber 5 and the actuator 7 and is designed to move the transport liquid from the reservoir 6 to the recovery chamber 5), the system 1 comprises at least one further reservoir 26, which is arranged between the inlet 2 and the separation unit 3 (in particular, the main chamber) and connects (directly) fluidically (i.e. so as to allow a passage of fluid) the inlet 2 and the separation unit 3 (in particular, the main chamber). In particular, the reservoir 26 is designed to contain at least part of the sample. In this case, the element 15 is arranged at the reservoir 6 and the reservoir 26.

In this case, in particular, the system 1 also comprises a further actuator (more precisely, a pump of type known per and not illustrated), which is designed to move the liquid from the reservoir 26 to the separation unit 3 (in particular, to the main chamber 4).

According to alternative and non-limiting embodiments, the actuator 7 is also designed to move the liquid from the reservoir 26 to the separation unit 3. In these cases, in particular, a diverter is provided which allows the fluid under pressure to be directed from the actuator 7 towards the reservoir 6 or towards the reservoir 26 so as to move the liquid from the reservoir 6 to the separation unit 3 or from the reservoir 26 to the separation unit 3, respectively.

According to some non-limiting embodiments, the reservoir 26 is arranged between this further actuator and the main chamber 4. According to some embodiments, the distance between the element 15 and the reservoir 26 is shorter than the distance from the element 15 to the separation unit 3 (more precisely, to the main chamber 4 and to the separation chamber 3).

In particular, the reservoir 26 has a (internal) volume of at least 1 μL. More specifically, the reservoir 26 has a (internal) volume up to 10 mL.

According to some non-limiting embodiments, the system 1 comprises a duct 27, which is fluidically connected to the main chamber 4 to receive liquid coming from the main chamber 4; at least one outlet 10, which is fluidically connected to the recovery chamber 5 and through which, in use, at least part of the particles of the given type collected in the recovery chamber 5 pass; and at least one duct 28 to fluidically connect the recovery chamber to the outlet.

In these cases, the element 15 is arranged in the area of the ducts 27 and 28 (and of the reservoirs 6 and 26).

According to some non-limiting embodiments, the system 1 comprises a microfluidic device 11, which comprises the main chamber 4, the recovery chamber 5, the reservoir 6 (and if necessary the reservoir 26, the ducts 27 and 28 and the outlet 10). In particular, in use, at least part of the particles of the given type collected in the recovery chamber 5 flow out of the microfluidic device 11 through the outlet 10.

According to some non-limiting embodiments, the separation unit 3 comprises a system of electrodes for the selective movement of the particles.

In some cases, the separation unit comprises a system chosen from the group consisting of: dielectrophoresis, optical tweezers, magnetophoresis, acoustophoresis (and a combination thereof). In particular, the separation unit comprises (is) a dielectrophoresis system.

According to some embodiments, the dielectrophoresis system and/or the operation thereof is as described in at least one of the patent applications with publication numbers WO0069565, WO2007010367, WO2007049120.

Advantageously but not necessarily, the system 1 comprises an apparatus 12 for the manipulation (for the isolation) of particles; the apparatus 12 is provided with a seat 29 (partially and schematically illustrated in FIG. 1), in which the device 11 is housed and which is movable between an opening position and a closing position (for further detail in this regard, see for example the patent applications with publication number WO2010/106434 and WO 2012/085884). The apparatus 12 comprises the actuator 7 and the regulating assembly 13 (and if necessary the cited further actuator). In particular, the device 11 is removable from the apparatus 12, when the seat 29 is in the opening position.

According to some embodiments, the apparatus 12 comprises electrical connectors to electrically connect the apparatus 12 to the microfluidic device 11. In this case, the microfluidic device 11 has further electrical connectors 11' couplable with the cited electrical connectors.

According to some non-limiting embodiments, the system 1 (in particular, the regulating assembly 13) comprises a control device 30 (FIG. 1), which is designed to control the regulating device 14 so as to maintain the temperature of the reservoir 6 (and if necessary of the cited further reservoir and ducts 27 and 28) substantially constant. In particular, the control device 30 is designed to control the regulating device 14 so as to maintain the temperature of the element 15 substantially constant. In particular, the control device 30 is designed to adjust the temperature of the heat transfer element 15.

More precisely, the control device 30 is designed to control the regulating device 14 according to the parameters detected by the sensor 24 so as to adjust the temperature of the heat transfer element 15, in particular so as to maintain the temperature of the heat transfer element 15 at one or more defined values (more specifically, in a defined temperature range).

In particular, the control device 30 is designed to operate the regulating device 14 so as to maintain the temperature of the element 15 from approximately 0° C. to approximately 40° C. (more specifically, from approximately 15° C. to approximately 25° C.)

More precisely, the control device 30 adjusts the operation of the heat pump 16 according to the parameters detected by the sensor 24 (and by the sensor 25). Even more precisely, in use, when the sensor 24 detects a temperature that is too high with respect to a reference temperature, the control device 30 operates the heat pump 16 so as to remove more heat from the element 15.

Advantageously but not necessarily, the regulating assembly 13 comprises at least one further regulating device 31 having at least one heat transfer element 32, which is arranged at the separation unit 3 to adjust the temperature of the main chamber 4 and (and/or) of the recovery chamber 5 (in particular to absorb heat from the main chamber 4 and/or from the recovery chamber 5).

According to some embodiments, the element 32 is not present at (in contact with) the reservoir 6 (more precisely, a wall of the reservoir 6) (and possibly the reservoir 26) (and possibly the ducts 27 and 28). According to some embodiments, the distance between the element 32 and the reservoir 6 (and possibly the reservoir 26) (and possibly the ducts 27 and 28) is greater than the distance from the element 32 to the separation unit 3 (more precisely, to the main chamber 4 and to the recovery chamber 5).

In this case, advantageously, the control device 30 is designed to control (operate) the regulating devices 14 and 31 independently of each other. In particular, the control device 30 is designed to adjust the temperature of the heat transfer elements 15 and 32 independently of each other.

In particular, the control device 30 is designed to adjust the temperature of the heat transfer element 32.

More in particular, the control device 30 is designed to control the regulating device 31 so as to maintain the temperature of the element 32 from approximately −20° C. to approximately 40° C. (more precisely, from approximately −5° C. to approximately 20° C.)

It has been observed that with both the regulating assembly 13 and the regulating device 31, particularly good results are obtained since it is possible to adjust the temperature of the separation unit 3 and the reservoir 6 (together with any other reservoirs and/or ducts) in an independent manner. The separation unit 3 and the reservoir 6 operate typically in very different conditions.

According to specific non-limiting embodiments (like the one illustrated in FIG. 1), the regulating device 31 comprises similar components substantially identical to those of the regulating device 14 which cooperate with one another in a substantially identical manner to what is described above for the regulating device 14. More precisely, the regulating device 31 comprises a thermal insulator (not illustrated), a heat pump 33 (in particular a Peltier cooler), a sensor 34 to detect the temperature of the element 32 and a cooling circuit 35, which is provided with two ducts 36 and 37, a pump 38, a radiator 39 and a fan 39'.

According to some non-limiting embodiments, the heat pump 33 (Peltier cooler) is designed to operate with a power of 20-30 Watt (in particular, 24-16 Watt).

The control device 30 acts on the elements of the regulating device 31 analogously to what is described above for the regulating device 14. Also in this case, more precisely, the control device 30 adjusts operation of the heat pump 33 according to the parameters detected by the sensor 34.

In particular, the control device 30 is designed to operate the regulating device 31 so as to maintain the temperature of the separation unit 3 substantially constant. The control device 30 is designed to operate the regulating device 31 so as to maintain the temperature of the element 32 substantially constant.

According to specific non-limiting embodiments (like the one illustrated), the control device 30 comprises a control unit 41, which is designed to control (operate) the regulating device 14, and a control unit 40, which is designed to control (operate) the regulating device 31.

Advantageously but not necessarily, the elements 15 and 32 are arranged on opposite sides of the microfluidic device 11. This reduces the possibility of their interfering with each other.

More precisely, the system 1 does not comprise further regulating devices (for example, comprising a heat pump and/or a cooling circuit, through which a cooling liquid flows, in use), designed to adjust the temperature of (in particular, to absorb heat from) the device 11 or a part thereof and comprising respective heat transfer elements (arranged at least in the vicinity of, in particular in contact with, the device 11).

More in particular, the elements 15 and 32 are arranged above and below (respectively) the microfluidic device 11.

According to some embodiments, the element 15 is arranged at a distance of less than 500 μm (in particular, less than 300 μm) from the device 11.

Advantageously but not necessarily, the element 32 is arranged separate from (not in contact with) the device 11. In particular, the element 32 is arranged at least 0.1 μm from the device 11.

In some cases, the element 15 is arranged in contact with the device 11.

Advantageously but not necessarily, the regulating device 14 (more precisely, the element 15) has a through opening (a hole) 42. In particular, the opening 42 is arranged at the separation unit 3 (more precisely, at the main chamber 4 and the recovery chamber 5). According to some embodiments, the opening 42 is arranged at the element 32.

It should be noted that the opening 42 allows what happens in the separation unit 3 (in particular, in the main chamber 4 and/or in the recovery chamber 5) to be optically detected. This allows the selective movement of the particles of given type to be identified and controlled in a simple efficient manner.

Figure 5:
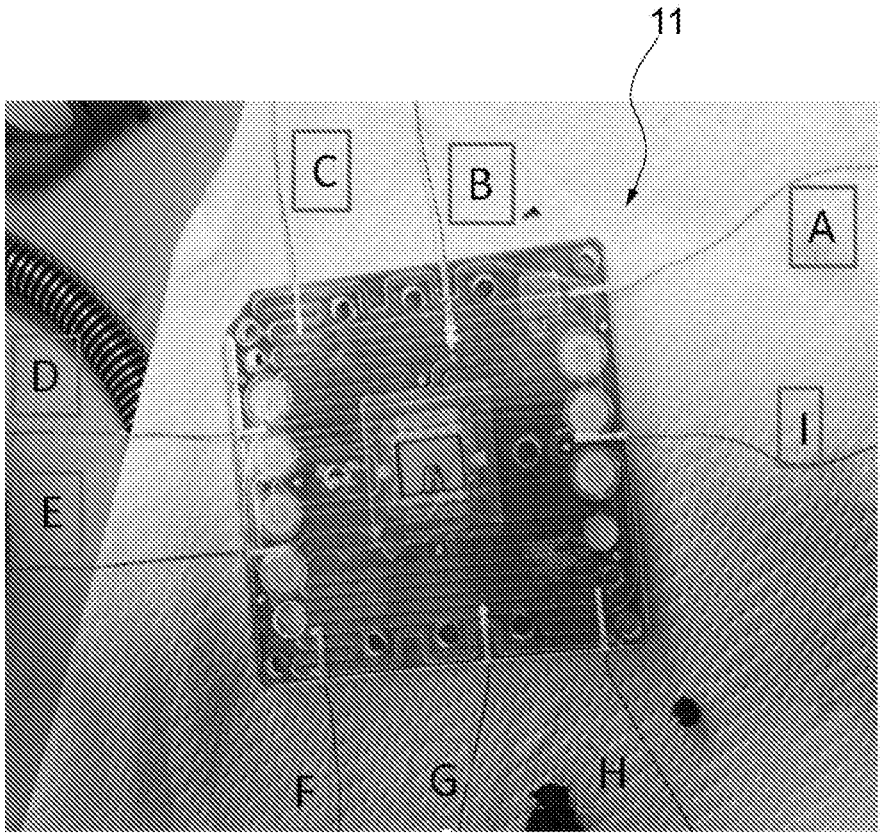
FIG. 5 is a photograph of a component of the system of FIG. 1 connected to sensors during an experimental test.

With particular reference to FIG. 5, tests were carried out to test the system 1 according to the present invention. For example, in operating conditions it was possible to maintain the temperature of the reservoir 6 at a temperature ranging from 16° C. to 17° C. From the tests conducted, it emerged that it is possible to correctly control the temperature of the reservoir 6 and other parts. In FIG. 5 the letters from A to I indicate temperature sensors.

According to some non-limiting embodiments not illustrated, the regulating assembly 13 comprises two (or more) regulating devices 14 (each structured and/or operating independently of the other as indicated above for the regulating device 14). One of the regulating devices 14 is arranged at the reservoir 6 to adjust the temperature thereof; the other regulating device 14 is arranged in the reservoir 26 to adjust the temperature thereof. The system 1 comprises the control device 30, which is designed to control (operate) the regulating devices 14 independently of each other. In particular, in this way it is possible to keep the two reservoirs 6 and 26 at different temperatures from each other. More precisely, the regulating devices 14 each have a respective element 15, said elements being separate from each other (i.e. not in contact).

According to a second aspect of the present invention, an apparatus 12 is provided as defined above.

Unless explicitly indicated otherwise, the contents of the references (articles, books, patent applications etc.) cited in this text are referred to here in full. In particular the mentioned references are herein incorporated by reference.

The invention claimed is:

1. A microfluidic system for the isolation of particles of at least one given type from a sample; the microfluidic system comprising:

an inlet, through which, in use, the sample is introduced into the microfluidic system;

a separation unit which comprises a main chamber and a recovery chamber and which is configured to transfer at least part of the particles of the given type from the main chamber to the recovery chamber in a selective manner with respect to further particles of the sample;

at least one first reservoir having an inner volume of at least 1 μL, which is designed to contain a liquid and is fluidically connected to the separation unit; and at least one actuator configured to move the liquid from the first reservoir to the separation unit;

the microfluidic system being characterized in that it comprises a regulating assembly, which comprises at least one first regulating device having at least one first heat transfer element which is arranged at the first reservoir, such that the at least first heat transfer element is configured to absorb heat from the first reservoir itself; the separation unit comprising a system selected from the group consisting of dielectrophoresis, optical tweezers, magnetophoresis, acoustophoresis and a combination thereof.

2. The microfluidic system according to claim 1, wherein the regulating assembly comprises a control device which is designed to control the first regulating device so as to adjust the temperature of the first heat transfer element and so as to maintain the temperature of the first heat transfer element in a defined temperature range.

3. The microfluidic system according to claim 1, wherein the regulating assembly comprises a temperature sensor to detect the temperature of the first heat transfer element; and a control device designed to control the first regulating device according to the parameters detected by the temperature sensor so as to adjust the temperature of the element.

4. The microfluidic system according to claim 1, wherein the regulating assembly comprises at least a second regulating device having at least a second heat transfer element, which is arranged in the area of the separation unit to adjust the temperature of the main chamber and the recovery chamber.

5. The microfluidic system according to claim 4, and comprising a control device, which is designed to control the first and the second regulating device independently from each other.

6. The microfluidic system according to claim 5, wherein the control device comprises a first and a second control unit independent of each other; the first control unit is designed to control the first regulating device; the second control unit is designed to control the second regulating device.

7. The microfluidic system according to claim 4, further comprising a microfluidic device which, in turn, comprises the main chamber, the recovery chamber and the first reservoir; the first and the second heat transfer element are arranged on opposite sides of the microfluidic device.

8. The microfluidic system according to claim 7, wherein the second heat transfer element is arranged in contact with the microfluidic device;

the first heat transfer element is arranged at a distance of less than 500 pm from the microfluidic device.

9. The microfluidic system according to claim 1, further comprising at least one second reservoir, which fluidically connects the inlet to the separation unit and is designed to contain at least part of the sample; the first reservoir being fluidically connected to the recovery chamber; the first heat transfer element being arranged at the first and the second reservoir and the second reservoir is arranged between the inlet and the main chamber and fluidically connects the inlet to the main chamber.

10. The microfluidic system according to claim 9, further comprising at least one first duct, which is fluidically connected to the main chamber (4) to receive liquid coming from the main chamber; at least one outlet, which is fluidically connected to the recovery chamber and through which, in use, at least part of the particles of the given type collected in the recovery chamber flow; and at least one second duct for fluidically connecting the recovery chamber to the outlet.

11. The microfluidic system according to claim 10, further comprising a microfluidic device, which comprises the main chamber, the recovery chamber, the first, the second reservoir and the first and second duct; in use, at least part of the particles of the given type collected in the recovery chamber flow out of the microfluidic device through said outlet.

12. The microfluidic system according to claim 7, further comprising an apparatus for the manipulation of particles which is provided with a seat housing the microfluidic device, which comprises first electrical connectors designed to electrically connect the apparatus to the microfluidic device and which is movable between an opening position and a closing position; the microfluidic device has further electrical connectors which are coupled to the first electrical connectors in a separable manner and can be removed from the apparatus when the seat is in the opening position; the apparatus comprising the actuator and the regulating assembly.

13. The microfluidic system according to claim 1, wherein the separation unit comprises an electrodes system for selective movement of the particles.

14. The microfluidic system according to claim 1, wherein the regulating device for the transfer of heat has a through opening in the area of the separation unit to allow what happens in the separation unit to be monitored.

15. The microfluidic system according to claim 1, wherein the regulating assembly comprises a sensor for detecting the temperature of the first heat transfer element and a control device for controlling the first regulating device depending on the parameters detected by the sensor, so as to adjust the temperature of the first heat transfer element to keep the temperature of the first heat transfer element at one or more defined values.

16. The microfluidic system according to claim 1, wherein the regulating assembly comprises the first and at least a second regulating device; the first regulating device is arranged at the first reservoir, to adjust the temperature thereof; the second regulating device is arranged at the second reservoir, to adjust the temperature thereof; the system comprises a control device, which is designed to control the first and the second regulating device independently of each another.

17. The microfluidic system according to claim 1, wherein the regulating assembly comprises a heat pump for absorbing heat from the first heat transfer element; the heat pump comprises a Peltier cooler.

18. The microfluidic system according to claim 1, wherein the first regulating device comprises a heat exchanger and a cooling circuit, through which, in use, a cooling liquid flows.

19. An apparatus, comprising; a seat designed to house a microfluidic device that comprises a main chamber, a recovery chamber and a first reservoir designed to contain a liquid, wherein the seat is movable between an open position and a closed position;

first electrical connectors configured to electrically connect the apparatus to the microfluidic device;

at least one actuator configured to move the liquid from the first reservoir to the main chamber; and a regulating assembly, which comprises at least one first regulating device having at least one first heat transfer element which is arranged at a first reservoir, wherein the at least first heat transfer element is configured to absorb heat from the first reservoir.

20. The microfluidic system of claim 4, wherein the second heat transfer element absorbs heat from the main chamber and from the recovery chamber.

21. The microfluidic system of claim 5, wherein the control device is designed to adjust the temperature of the first and the second heat transfer element independently of each other.

22. The microfluidic system of claim 7, wherein the first and the second heat transfer element are arranged above and below the microfluidic device.

* * * * *